US008882106B2

(12) United States Patent
Maenishi et al.

(10) Patent No.: US 8,882,106 B2
(45) Date of Patent: Nov. 11, 2014

(54) POST-PROCESSING APPARATUS HAVING SHEET ALIGNMENT FUNCTION AND METHOD OF CONTROLLING THE SAME

(71) Applicant: Canon Kabushiki Kaisha, Tokyo (JP)

(72) Inventors: Hiromasa Maenishi, Matsudo (JP); Takashi Yokoya, Kashiwa (JP)

(73) Assignee: Canon Kabushiki Kaisha (JP)

( * ) Notice: Subject to any disclaimer, the term of this patent is extended or adjusted under 35 U.S.C. 154(b) by 0 days.

(21) Appl. No.: 13/734,394

(22) Filed: Jan. 4, 2013

(65) Prior Publication Data

US 2013/0174703 A1 Jul. 11, 2013

(30) Foreign Application Priority Data

Jan. 10, 2012 (JP) ..... 2012-002152
Dec. 21, 2012 (JP) ..... 2012-279474

(51) Int. Cl.

| | |
|---|---|
| ***B65H 9/00*** | (2006.01) |
| ***B65H 7/10*** | (2006.01) |
| ***B26D 7/01*** | (2006.01) |
| ***G03G 15/00*** | (2006.01) |
| ***B26F 1/00*** | (2006.01) |
| ***B65H 9/10*** | (2006.01) |
| ***B26D 3/00*** | (2006.01) |

(52) U.S. Cl.

CPC ..... *B65H 9/002* (2013.01); *B65H 7/10* (2013.01); *B65H 2301/5152* (2013.01); *B26D 7/015* (2013.01); *B65H 2511/222* (2013.01); *G03G 15/6544* (2013.01); *B65H 2511/22* (2013.01); *B26F 1/0092* (2013.01); *B65H 9/10* (2013.01); *B26D 3/00* (2013.01); *B65H 2701/1315* (2013.01)

USPC ..... 271/249; 270/58.07; 270/58.11; 270/58.12; 270/58.17; 270/58.27; 271/228; 271/230; 271/252

(58) Field of Classification Search

USPC ..... 270/58.11, 58.12, 58.07, 58.17, 58.27; 271/184, 185, 226, 228, 230, 234, 238, 271/240, 248, 249, 250, 252

See application file for complete search history.

(56) References Cited

U.S. PATENT DOCUMENTS

| | | | | |
|---|---|---|---|---|
| 5,513,839 | A * | 5/1996 | Green | 270/58.07 |
| 6,019,365 | A * | 2/2000 | Matsumura | 271/227 |
| 7,333,767 | B2 | 2/2008 | Kaneko et al. | |
| 7,404,557 | B2 * | 7/2008 | Tada et al. | 271/226 |
| 7,451,980 | B2 * | 11/2008 | Tamura et al. | 271/220 |
| 7,581,725 | B2 * | 9/2009 | Fujita et al. | 270/58.17 |
| 7,731,187 | B2 * | 6/2010 | Horio et al. | 271/217 |
| 7,802,782 | B2 * | 9/2010 | Moriyama et al. | 270/58.12 |
| 7,866,652 | B2 * | 1/2011 | Fujita et al. | 270/58.17 |
| 8,066,279 | B2 * | 11/2011 | Ishikawa et al. | 271/228 |
| 8,181,950 | B2 * | 5/2012 | Kato et al. | 270/58.07 |
| 2008/0217845 | A1 * | 9/2008 | Kushida | 271/226 |

* cited by examiner

*Primary Examiner* — Leslie A Nicholson, III

(74) *Attorney, Agent, or Firm* — Rossi, Kimms & McDowell LLP

(57) ABSTRACT

A post-processing apparatus which enable reduction of shift alignment time and improvement of productivity. A shift unit performs a shifting operation for shifting a conveyed sheet, in a lateral direction orthogonal to a sheet conveying direction. An alignment unit aligns the sheet by a pair of alignment members thereof which are moved toward each other such side edges of the sheet in the lateral direction are held therebetween. A CPU of a finisher controller controls the alignment unit and the shift unit such that an operation for moving the alignment members from respective first standby positions in the lateral direction to respective second standby positions closer to the sheet than the corresponding first standby positions is executed in parallel with the shifting operation by the shift unit.

12 Claims, 15 Drawing Sheets

POST-PROCESSING APPARATUS HAVING SHEET ALIGNMENT FUNCTION AND METHOD OF CONTROLLING THE SAME

BACKGROUND OF THE INVENTION

1. Field of the Invention

The present invention relates to a post-processing apparatus and a method of controlling the same, and more particularly to a technique of controlling a post-processing apparatus that punches a hole at a predetermined position of a conveyed sheet.

2. Description of the Related Art

Conventionally, there has been widely known a post-processing apparatus that punches sheets discharged from an image forming apparatus, such as a printer, a copying machine, and a facsimile machine.

A post-processing apparatus conveys a sheet received from an image forming apparatus along a conveyance passage to a punching unit. In doing this, in a state in which an abutment member is retracted from the conveyance passage of the sheet, the sheet is conveyed by being nipped between conveyance rollers. The abutment member is a member for having a trailing end of the sheet abutted thereon by switching the sheet back thereto, to thereby position the trailing end of the sheet and eliminate skewing of the trailing end side of the sheet. After a leading end of the sheet passes a punching position, the sheet is moved to a center position in a lateral direction (direction orthogonal to a sheet conveying direction), by a shifting operation for shifting the conveyance rollers nipping the sheet in the lateral direction. Thereafter, when the trailing end of the sheet passes the punching position, the abutment member is returned to the conveyance passage. Then, nipping of the sheet by the conveyance rollers is cancelled, and a sheet alignment in the lateral direction is performed using a pair of alignment members. Subsequently, the sheet is nipped by conveyance rollers, and further, the trailing end of the sheet is caused to abut against the abutment member, whereafter punching is performed on the sheet by a punching unit (see U.S. Pat. No. 7,333,767).

According to U.S. Pat. No. 7,333,767, the alignment members are kept on standby at a position distant from the conveying center position in the lateral direction (hereinafter referred to as a "defined center position") so as to prevent the conveyed sheet from being brought into contact with either of the alignment members. The retracted position of each alignment member is set by taking into account a case where the conveyed sheet is most greatly displaced from the defined center position. In other words, the amount of shift of each alignment member is fixed regardless of the amount of displacement of the sheet, and hence there is a problem that it requires the same shift alignment time irrespective of the magnitude of the amount of displacement of the sheet, which makes it impossible to improve productivity. The shift alignment time represents a time period from a time when a sheet shifting operation is started to a time when skewing is corrected by the alignment members.

As a solution to the abovementioned problem, there is provided a method of setting the standby position of each alignment member closer to the defined center position. In this case, however, when the amount of displacement is large, there is a possibility that the sheet is damaged by being brought into contact with either of the alignment members.

SUMMARY OF THE INVENTION

The present invention provides a post-processing apparatus and a method of controlling the same, which enable reduction of shift alignment time and improvement of productivity.

In a first aspect of the present invention, there is provided a post-processing apparatus comprising a conveying unit configured to convey a sheet, a shift unit configured to perform a shifting operation for shifting the sheet conveyed by the conveying unit in a lateral direction orthogonal to a sheet conveying direction, an alignment unit configured to align the sheet, the alignment unit including a pair alignment members, the pair of alignment members being moved toward each other such that side edges of the sheet in the lateral direction are held therebetween to thereby align the sheet, and a control unit configured to control the alignment unit and the shift unit such that an operation for moving the pair of alignment members from respective first standby positions in the lateral direction to respective second standby positions which are closer to the sheet than the corresponding first standby positions is executed in parallel with the shifting operation by the shift unit.

In a second aspect of the present invention, there is provided a method of controlling a post-processing apparatus including a conveying unit configured to convey a sheet, a shift unit configured to perform a shifting operation for shifting the sheet conveyed by the conveying unit in a lateral direction orthogonal to a sheet conveying direction, and an alignment unit configured to align the sheet, the alignment unit including a pair alignment members, the pair of alignment members being moved toward each other such that side edges of the sheet in the lateral direction are held therebetween to thereby align the sheet, the method comprising moving the sheet to a defined position in the lateral direction by the shift unit, moving the pair of alignment members, before an alignment operation by the alignment unit, from respective first standby positions in the lateral direction, to respective second standby positions closer to the sheet than the corresponding first standby positions, and controlling an execution timing of shifting of the sheet to the defined position in the lateral direction and an execution timing of movement of the pair of alignment members to the respective second standby positions such that the shifting of the sheet to the defined position in the lateral direction and the movement of the pair of alignment members to the respective second standby positions are executed in parallel with each other.

According to the present invention, it is possible to reduce the shift alignment time from a time when a sheet shifting operation is started to a time when skewing is corrected by the alignment member and improve productivity. Further, even if the sheet being conveyed is largely displaced from the defined center position, the sheet is not brought into contact with any of the alignment members to prevent the sheet from being damaged, whereby it is possible to preserve the quality of the sheet.

Further features of the present invention will become apparent from the following description of exemplary embodiments with reference to the attached drawings.

DESCRIPTION OF THE EMBODIMENTS

The present invention will now be described in detail below with reference to the accompanying drawings showing embodiments thereof.

Figure 1:
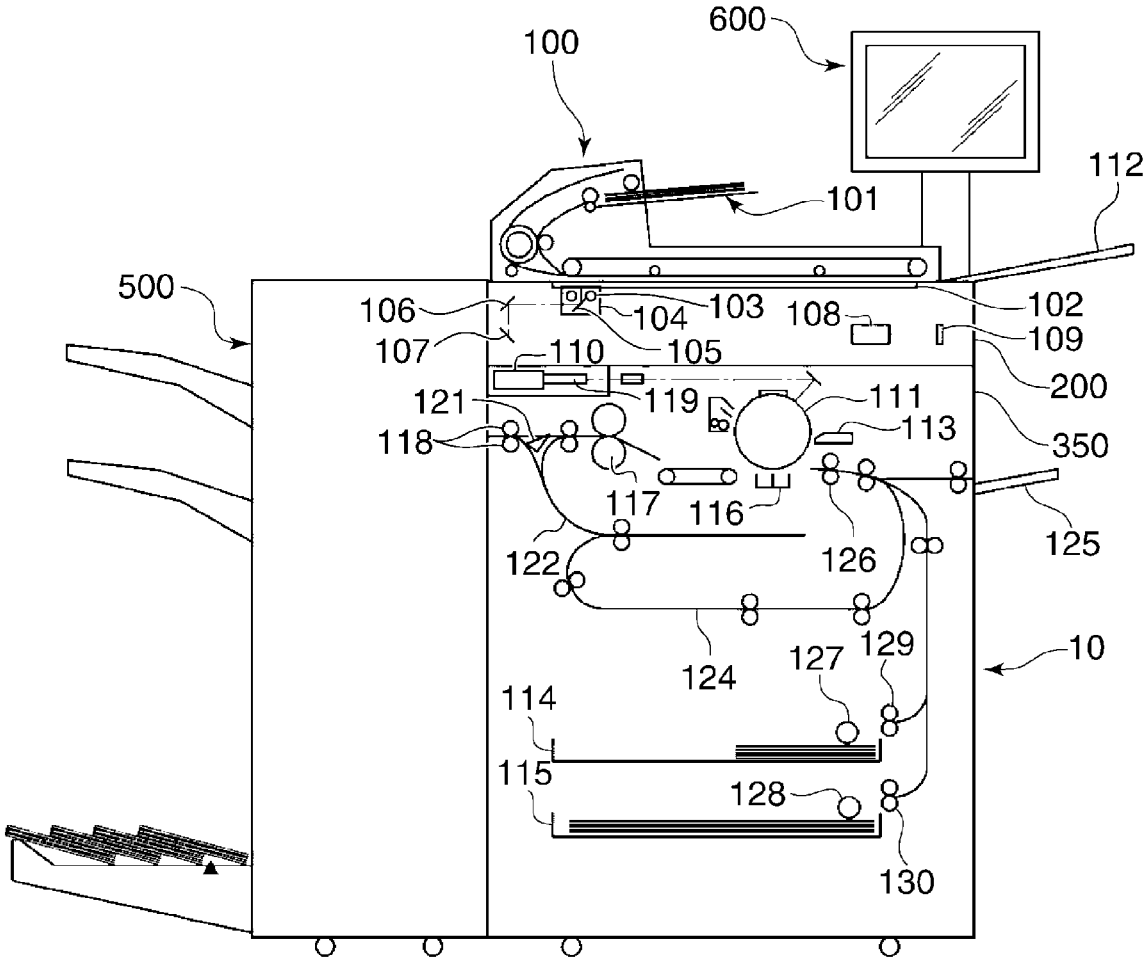
FIG. 1 is a schematic longitudinal cross-sectional diagram of an image forming apparatus having a finisher connected thereto which is a post-processing apparatus according to an embodiment of the present invention.

FIG. 1 is a schematic longitudinal cross-sectional diagram of essential parts of an image forming apparatus having a finisher connected thereto which is a post-processing apparatus concerning to an embodiment of the present invention.

The image forming apparatus 10 comprises an image reader 200 that reads an image from an original, and a printer 350 that performs image formation on a sheet based on the read image. A document feeder 100 feeds a sheet one by one from a first page of a document of originals on a document tray 101 each set with an image-formed surface up, in a leftward direction as viewed in FIG. 1. Then, the document feeder 100 conveys each original via a curved conveying passage onto a platen glass 102, along which the original is conveyed from the left, while passing a predetermined reading position, to the right, and discharges the original onto a discharging tray 112 disposed outside.

When the original passes the reading position on the platen glass 102 while being conveyed from the left to the right, an image of the original is read by a scanner unit 104 held at a position corresponding to the reading position. When the original passes the reading position, the original is illuminated with light from a lamp 103 of the scanner unit 104, and reflected light from the original is guided to a lens 108 via mirrors 105, 106 and 107. The light having passed the lens 108 forms an image on an imaging surface of an imaging sensor 109. Thus, by conveying an original such that the original passes the reading position while being conveyed from the left to the right, an original reading scan is performed.

When the original passes the reading position, an original image (image of an original) is read line by line in a main scanning direction by the imaging sensor 109 while conveying the original in a sub scanning direction, whereby the whole original image is read. In the present embodiment, the main scanning direction refers to a direction orthogonal to a conveying direction of the original and the sub scanning direction refers to the conveying direction.

A image optically read as described above is converted to image data by the imaging sensor 109, and is out therefrom. The image data output from the imaging sensor 109 is input to an exposure section 110 of the printer 350 as a video signal.

Note that the document feeder 100 can convey an original onto the platen glass 102 and stop the original at the predetermined position, and in this state, the scanner unit 104 can be caused to scan from the left to the right, to thereby read the original.

To read an original without using the document feeder 100, first, the user lifts the document feeder 100 and places an original on the platen glass 102. Then, the original is read by causing the scanner unit 104 to scan the same from the left to the right.

The exposure section 110 of the printer 350 modulates laser light based on the video signal input from the image reader 200, and outputs the modulated laser light. The modulated laser light is irradiated onto a photoconductive drum 111 while being scanned by a polygon mirror 119. On the photoconductive drum 111, an electrostatic latent image is formed according to the scanned laser light. This electrostatic latent image on the photoconductive drum 111 is visualized as a developer image by a developer supplied from a developing device 113.

On the other hand, a sheet fed by pickup a roller 127 or 128 from a lower cassette 114 or an upper cassette 115 equipped in the printer 350 is conveyed to a registration roller 126 by a feeding roller 129 or 130. Then, the registration roller 126 is driven a predetermined period after the start of irradiation of the laser light, and the sheet is conveyed to between a photoconductive drum 111 and a transfer section 116.

The developer image formed on the photoconductive drum 111 is transferred onto the fed sheet by the transfer section 116. The sheet onto which the developer image has been transferred is conveyed to a fixing section 117. The fixing section 117 fixes the developer image on the sheet by heating and pressing the sheet.

The sheet having passed the fixing section 117 is conveyed via a flapper 121 and a discharge roller 118, and is discharged out of the printer 350 to the outside of the image forming apparatus (into the finisher 500 appearing in FIG. 1).

To discharge a sheet with its image-formed surface down (face down), the sheet having passed the fixing section 117 is guided into an inversion conveyance passage 122 once by a switching operation of the flapper 121. Then, after a trailing end of the sheet passes the flapper 121, the sheet is switched back and discharged out of the printer 350 by the discharge roller 118. This manner of paper discharge is called an inversion sheet discharge. The inversion sheet discharge is performed when image formation is performed sequentially from a top page, e.g. when forming images read by using the document feeder 100 or when forming images output from a computer 905 (see FIG. 2). The discharged sheets has a correct page order.

Further, a hard sheet, such as an OHP sheet, can be fed from a manual sheet feeder 125, and when forming an image on such a hard sheet, the sheet is not guided into the inversion conveyance passage 122 and the sheet is discharged with its image-formed surface up (face up) by the discharge roller 118.

Further, in a case where double-sided printing for forming an image on both sides of a sheet is set, the sheet is guided into the inversion conveyance passage 122 by the switching operation of the flapper 121, and is then conveyed to a double-sided-printing conveyance passage 124. Then, the sheet guided into the double-sided-printing conveyance passage 124 is fed again to between the photoconductive drum 111 and the transfer section 116.

Next, the arrangement of a controller that provides control of the image forming apparatus 10 in FIG. 1 will be described with reference to FIG. 2.

Figure 2:
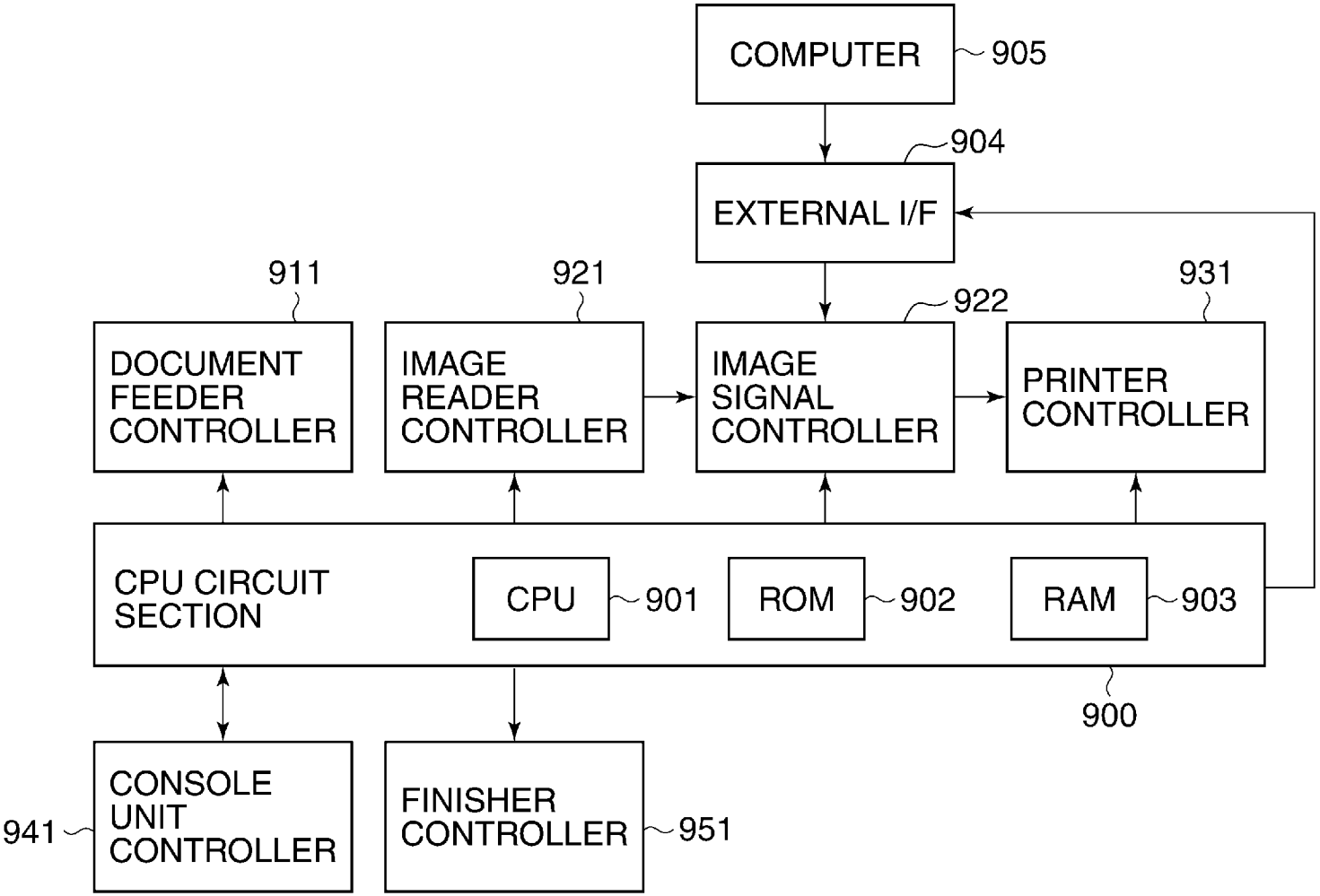
FIG. 2 is a schematic block diagram of a controller that provides control of the whole image forming apparatus in FIG. 1.

FIG. 2 is a schematic block diagram of the controller that provides control of the whole image forming apparatus in FIG. 1.

The controller has a CPU circuit section 900 containing a CPU 901, a ROM 902 and a RAM 903, as shown in FIG. 2. The CPU 901 performs a basic control of the whole image forming apparatus, and is connected to the ROM 902 having control programs written therein and the RAM 903 for use in performing processing, by an address bus and a data bus, both not shown. The CPU 901 performs centralized control of controllers (911, 921, 922, 904, 931, 941 and 951) by control programs stored in the ROM 902. The RAM 903 temporally holds control data, and is used as a work area for arithmetic operations involved in control processing.

A document feeder controller 911 drivingly controls the document feeder 100 based on instructions from the CPU circuit section 900. An image reader controller 921 drivingly controls the aforementioned scanner unit 104, imaging sensor 109, etc., and transfers an analog image signal output from the imaging sensor 109 to an image signal controller 922.

The image signal controller 922 performs various processing after converting the analog image signal from the imaging sensor 109 to a digital signal, and converts the digital signal to a video signal to output the video signal to a printer controller 931. Further, the image signal controller 922 performs various processing on a digital image signal input via an external I/F 904 from the computer 905, converts the digital image signal to a video signal and outputs the video signal to the printer controller 931. Processing operations by the image signal controller 922 are controlled by the CPU circuit section 900. The printer controller 931 controls the abovementioned exposure section 110 based on the input video signal.

A finisher controller 951 is mounted in the finisher 500, and drivingly controls the whole finisher by exchanging information with the CPU circuit section 900. Details of the control will be described hereinafter.

A console unit controller 941 exchanges information with a console unit 600 and the CPU circuit section 900. The console unit 600 has a plurality of keys 602 to 615 (see FIG. 5) for configuring various functions concerning image formation, a display section 620 (see FIG. 5) that displays information indicating a configuration state, etc., and outputs a key signal corresponding to an operation of each key to the CPU circuit section 900. Further, the console unit 600 displays, a signal from the CPU circuit section 900, corresponding information on the display section 620.

Next, the arrangement of the finisher 500 will be described with reference to FIG. 3.

Figure 3:
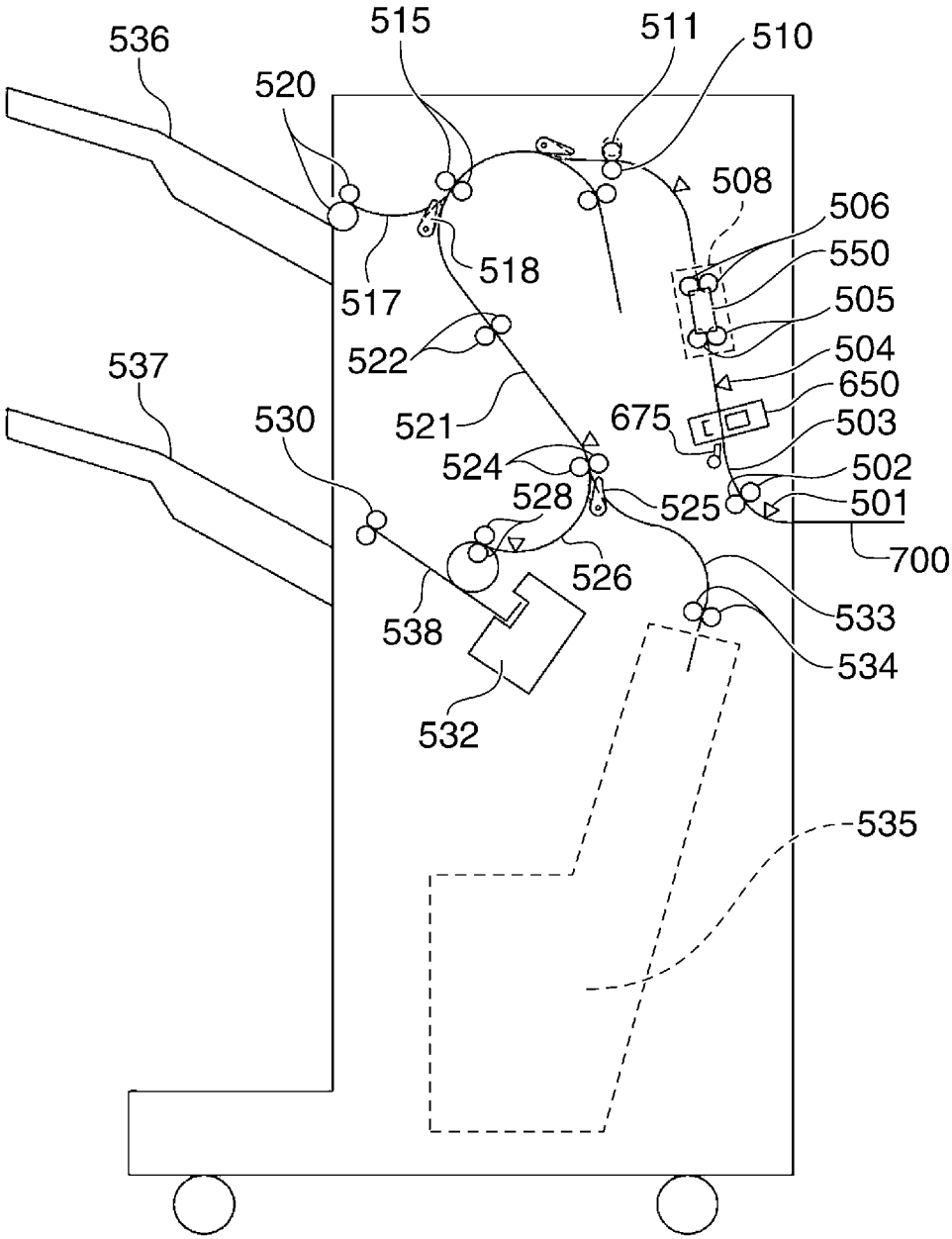
FIG. 3 is a schematic diagram showing a longitudinal cross-sectional structure of the finisher appearing in FIG. 1.

FIG. 3 is a schematic diagram showing a longitudinal cross-sectional structure of the finisher 500 appearing in FIG. 1.

A sheet 700 discharged from the image forming apparatus 10 passes an inlet sensor 501 and is passed to an inlet conveyance roller pair 502 of the finisher 500. The sheet 700 conveyed by the inlet conveyance roller pair 502 passes a conveyance passage 503, and is then passed to a first shift conveyance roller pair 505 and a second shift conveyance roller pair 506. Then, a position of a sheet edge (lateral edge) in a lateral direction orthogonal to a conveying direction of the sheet 700 is detected by a sheet position detection sensor 504. The sheet position detection sensor 504 is formed by a line sensor including a plurality of reading pixels, not shown, arranged in the lateral direction, and detects the position of the lateral edge of the sheet, based on positions of ones of the reading pixels which are detecting the sheet and positions of the others which are not detecting the sheet. Note that the sheet position detection sensor 504 may not be a line sensor, but may be a unit configured to move a sensor unit for detecting presence or absence of a sheet in the lateral direction to thereby detect the position of a lateral edge of the sheet. Based on a result of the detection of the position of the lateral edge, the lateral position of the sheet 700 being conveyed and an amount of displacement of the center position of the sheet 700 from the defined center position in the lateral direction (hereinafter referred to as a "lateral displacement amount") are computed. As mentioned hereinabove, the defined center position refers to the conveying center position in the lateral direction.

Next, the finisher 500 performs a shifting operation using a shift unit 508 to correct the displacement, while conveying the sheet 700 in the conveying direction using the first shift conveyance roller pair 505 and the second shift conveyance roller pair 506. Note that the shift unit 508 includes a fixed member 508A and a movable member 508B, and is configured to also perform an abutment/separation operation in which the movable member 508B is moved toward the fixed member to abut the fixed member 508A to thereby nip the sheet 700 between the fixed member 508A and the movable member 508B or the movable member 508B is moved in a direction separating from the fixed member 508A to release the nipping of the sheet 700. In parallel with the abovementioned shifting operation, the finisher 500 moves a pair of alignment members 550 to respective opposed sheet edges to thereby cause the sheet 700 to be aligned with the defined center position and corrects skewing of the sheet 700. Details of the shifting operation and the skew correction will be described hereinafter.

Next, the finisher 500 stops conveyance of the sheet 700, reverses the conveying direction of the sheet 700, conveys a predetermined amount, and causes a trailing end of the sheet 700 to abut against a rear end stopper member 675. Then, a punch unit 650 punches holes in a trailing end of the sheet 700. Then, after being conveyed by a conveyance roller 510, a separation roller 511, and a buffer roller pair 515, the sheet 700 is conveyed to an upper conveyance passage 517 or a bundle conveyance passage 521. When guiding the sheet 700 to the upper conveyance passage 517, a flapper 518 is brought into a state depicted in broken lines in FIG. 3 by a solenoid, not shown, whereby the sheet 700 is discharged into an upper tray 536 by an upper discharge roller pair 520.

On the other hand, when guiding the sheet 700 to the bundle conveyance passage 521, the flapper 518 is brought into a state depicted in solid lines in FIG. 3, whereby the sheet 700 passes through a conveyance passage 526 sequentially by a buffer roller pair 522 and a bundle conveyance roller pair 524. When subjecting sheets 700 to saddle stitching, the sheets 700 are conveyed to a saddle conveyance passage 533 by a flapper 525, guided by a saddle inlet roller pair 534 into a saddle unit 535, where the sheets 700 are subjected to saddle stitching. Saddle stitching is general processing, but is not an essential part of the present invention, and hence detailed description thereof is omitted.

When discharging sheets 700 to a lower tray 537, the sheets 700 are conveyed to the conveyance passage 526 by the bundle conveyance roller pair 524 and the flapper 525. Then, the sheets are discharged onto a processing tray 538 by a lower discharge roller pair 528, and the sheets are subjected to alignment on the processing tray 538 by a return unit, not shown, including a paddle and a knurling belt. Then, after stapling is performed on a sheet bundle by a stapler 532 if required, the sheets are discharged onto the lower tray 537 by a bundle discharge roller pair 530.

Next, the arrangement of the finisher controller 951 that drivingly controls the finisher 500 will be described with reference to FIG. 4.

Figure 4:
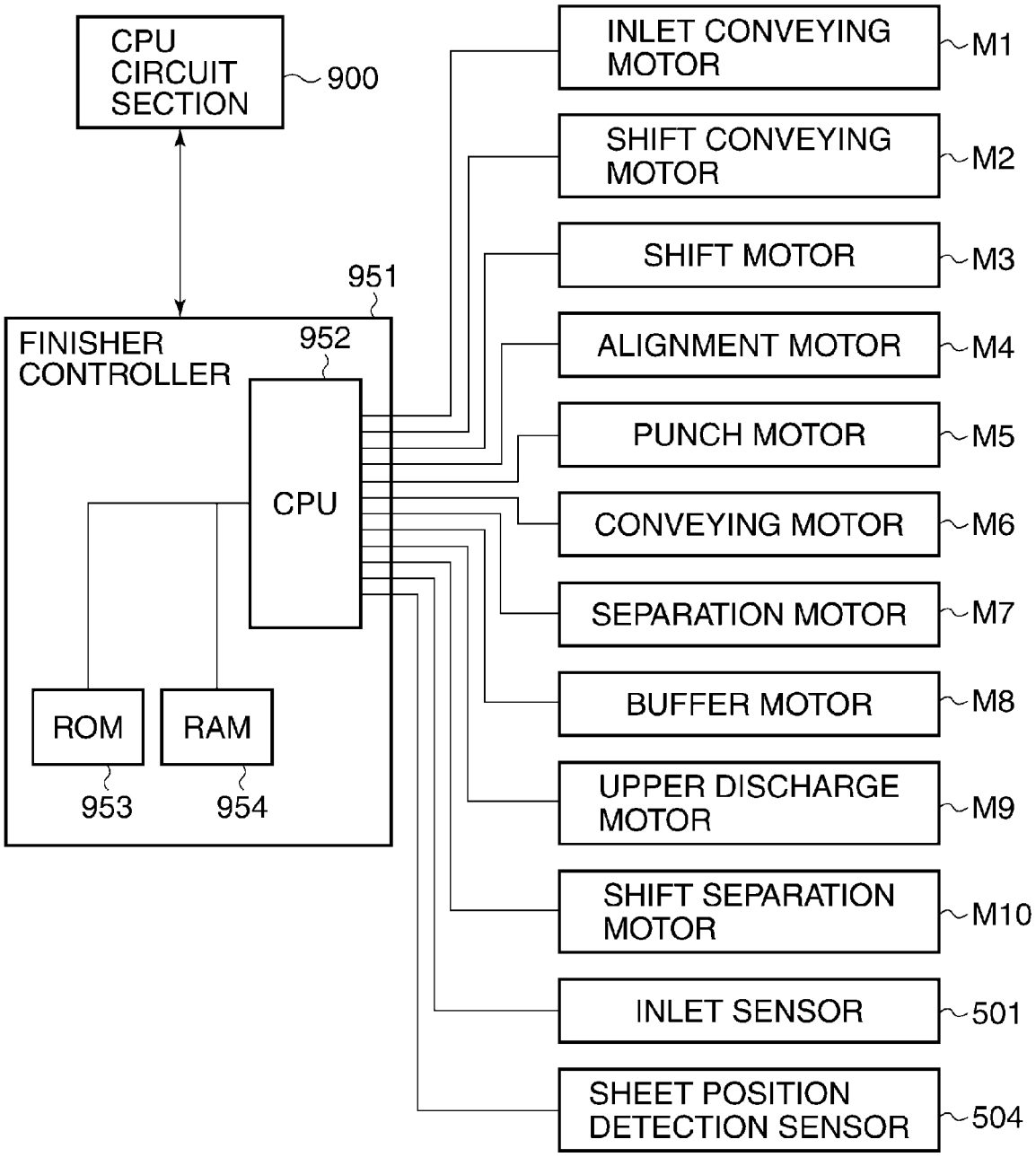
FIG. 4 is a block diagram of a finisher controller in FIG. 2.

FIG. 4 is a schematic block diagram of the finisher controller 951 in FIG. 2.

As shown in FIG. 4, the finisher controller 951 comprises a CPU 952, a ROM 953, and a RAM 954. The CPU 952 communicates with the CPU circuit section 900 of the image forming apparatus 10 for data exchange via a communication I/F, not shown. Further, according to instructions from the CPU circuit section 900, the CPU 952 executes various programs stored in the ROM 953 to drivingly control the finisher 500.

Further, the CPU 952 connects to an inlet conveying motor M1 that drives the inlet conveyance roller pair 502 for rotation and a shift conveying motor M2 that drives the first shift conveyance roller pair 505 and the second shift conveyance roller pair 506 for rotation, and controls the motors M1 and M2. Further, the CPU 952 connects to a shift motor M3 that shifts the shift unit 508, an alignment motor M4 that moves the alignment members 550, and a punch motor M5 that drives the punch unit 650, and controls the motors M3, M4, and M5. Further, the CPU 952 connects to a conveying motor M6 that drives the conveyance roller 510 for rotation, a separation motor M7 that drives the separation roller 511, and a buffer motor M8 that drives the buffer roller pair 515 for rotation, and controls the motors M6, M7 and M8. Further, the CPU 952 connects to an upper discharge motor M9 that drives the upper discharge roller pair 520 for rotation and a shift separation motor M10 that causes the movable member 508B of the shift unit 508 to perform the abutment/separation operation on the sheet 700 to be nipped between the fixed member 508A and the movable member 508B, and controls the motors M9 and M10.

Further, the CPU 952 receives input signals (detection signals) from the inlet sensor 501, the sheet position detection sensor 504, etc., for detecting passage of each sheet 700.

Figure 5:
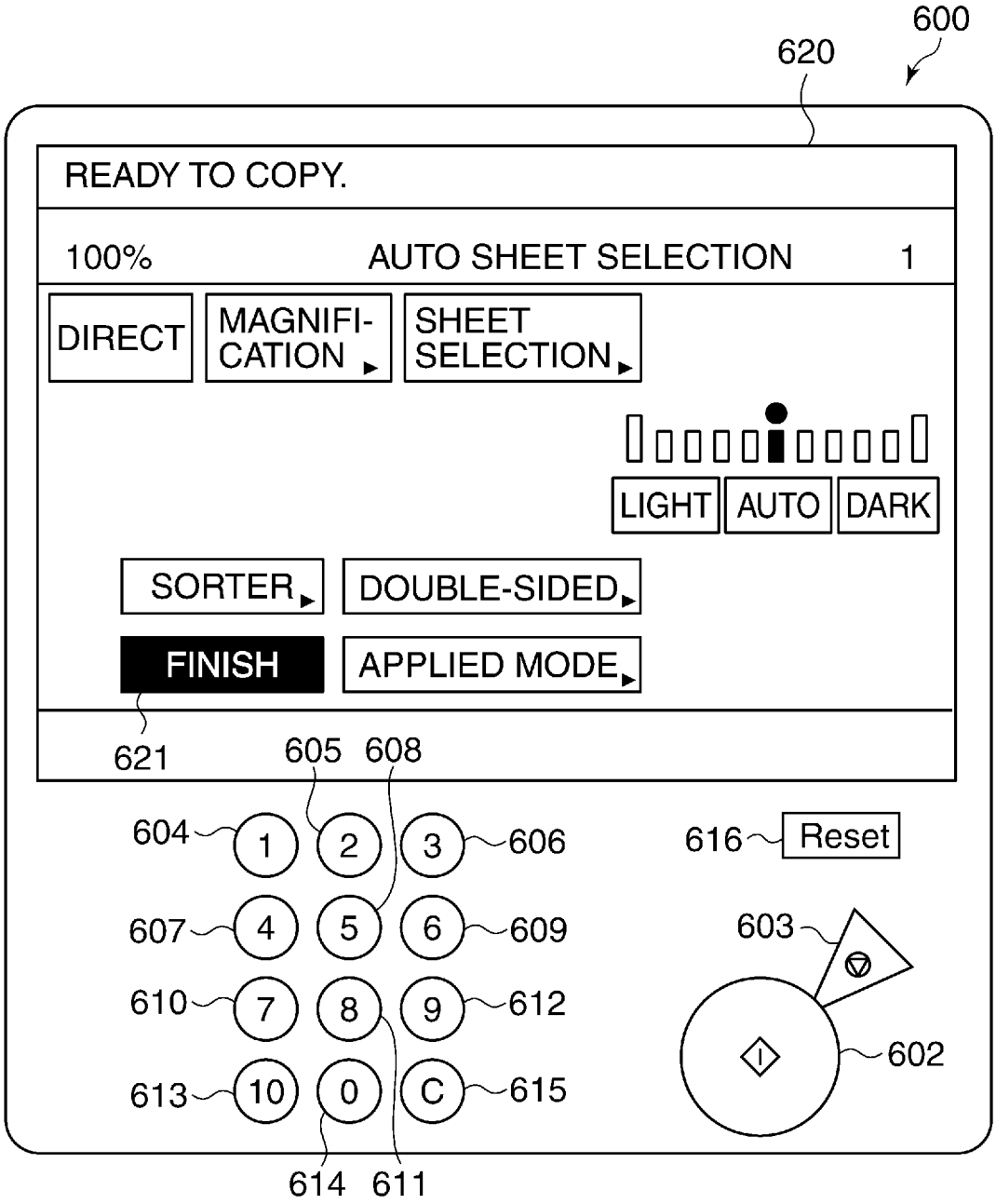
FIG. 5 is a view showing the appearance of a console unit of the image forming apparatus in FIG. 1.
Figure 6A:
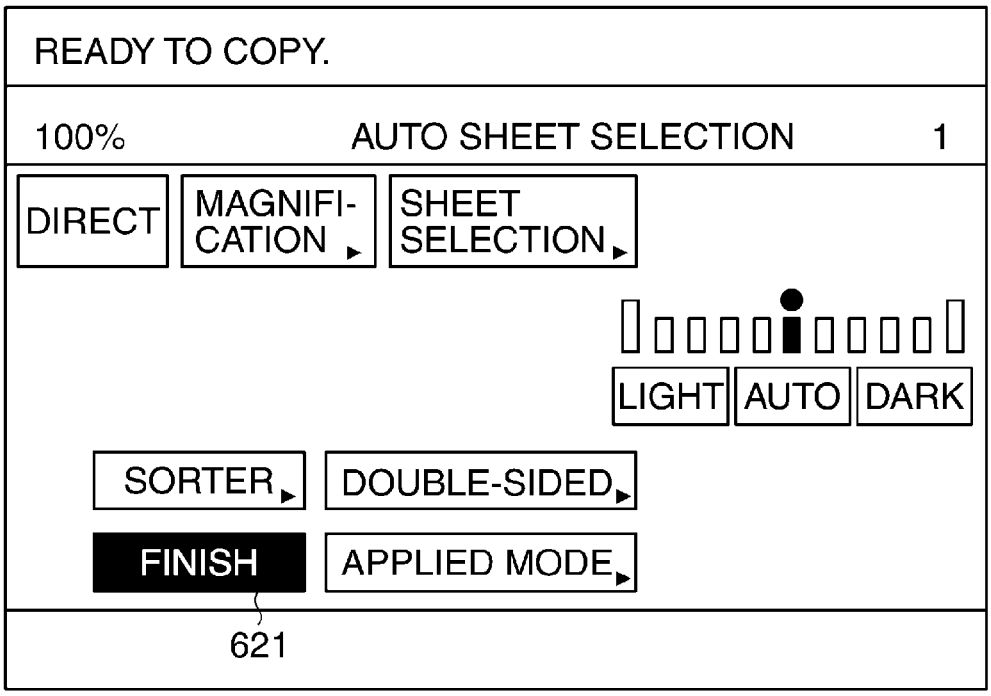
FIG. 6A is a view showing an example of an initial screen displayed on the console unit.
Figure 6B:
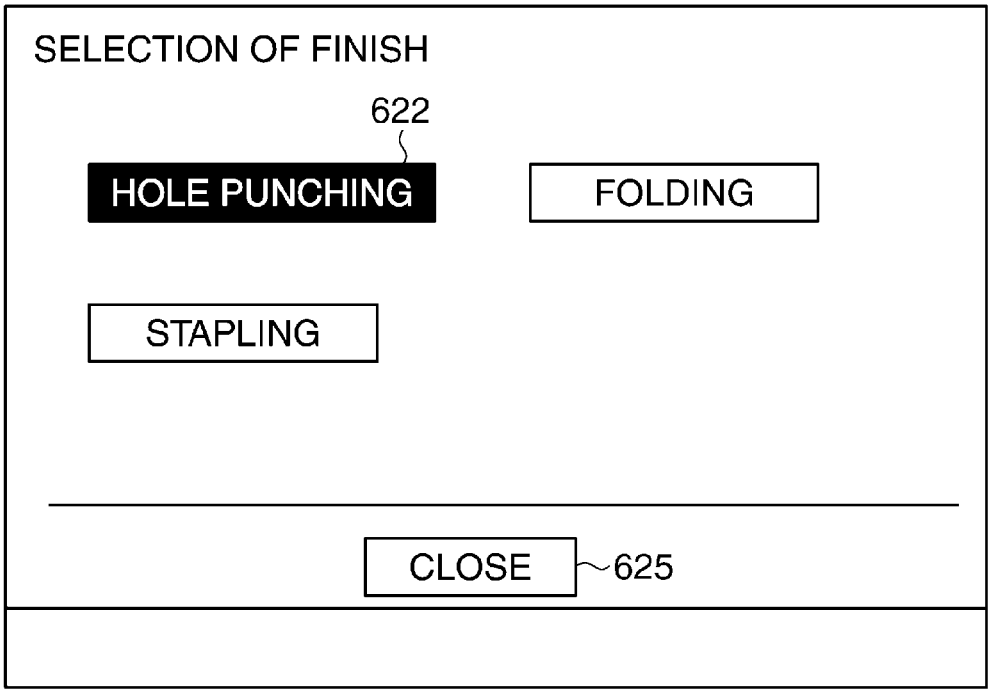
FIG. 6B is a view showing an example of a finish selection screen.
Figure 7A:
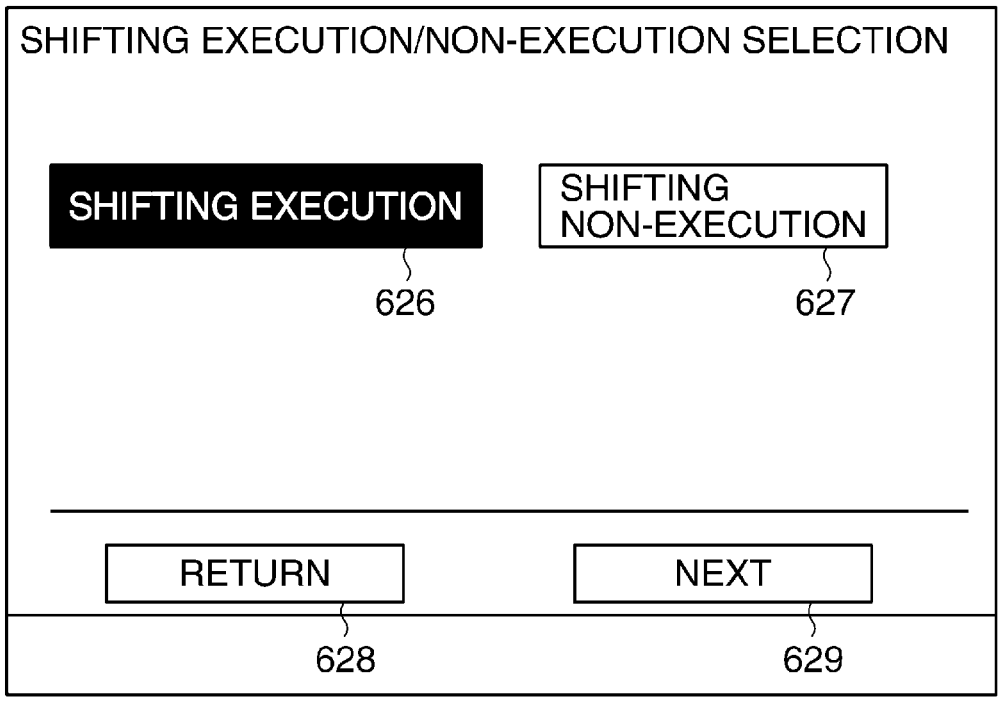
FIG. 7A is a view showing an example of a shifting execution/non-execution selection screen displayed on the console unit.
Figure 7B:
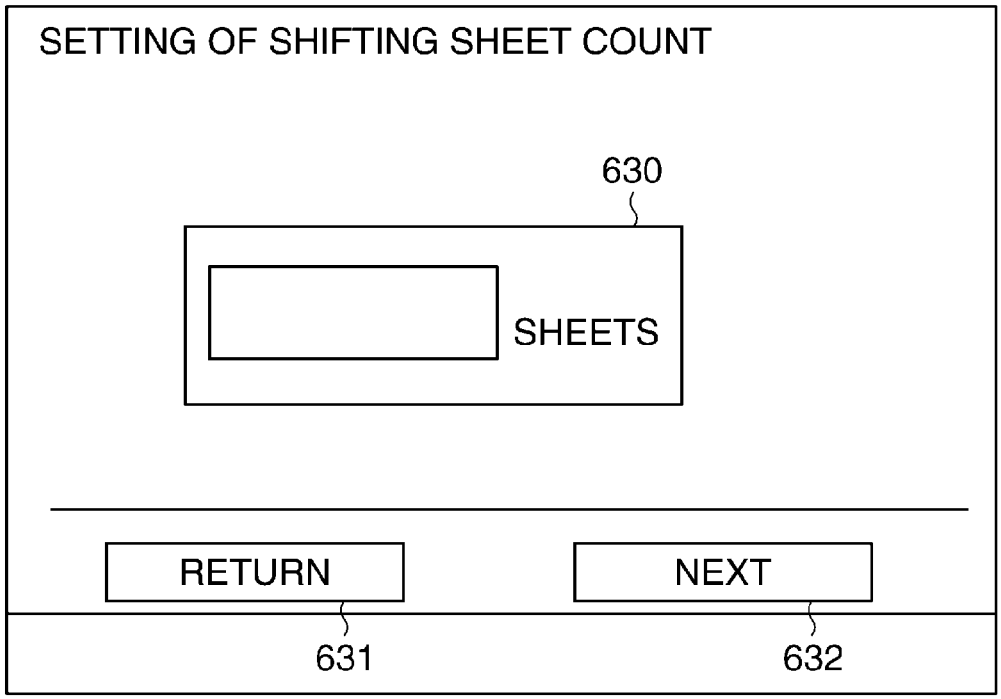
FIG. 7B is a view showing an example of a shifting sheet count-setting screen displayed on the console unit.

FIG. 5 is a view showing the appearance of the console unit 600 of the image forming apparatus 10 appearing in FIG. 1.

On the console unit 600, there are arranged a start button 602 for starting an image forming operation, and a stop key 603 for stopping the image forming operation. Further, there are arranged ten keys 604 to 612 and 614 for entering numerical data, an ID key 613, a clear key 615, a reset key 616, etc.

Further, the console unit 600 has the aforementioned display section 620 disposed in an upper part thereof, and the display section 620 includes a touch panel and is capable of displaying soft keys on its screen. For example, the image forming apparatus 10 has various processing modes, such as a punching mode, a sort mode, and a bookbinding mode, as post-processing modes of the finisher 500. Setting of any of these processing modes is performed by an input operation from the console unit 600.

Next, a procedure of setting the image forming apparatus 10 to the bookbinding mode will be described with reference to FIGS. 5, 6A, 6B, 7A and 7B.

A user sets the bookbinding mode by operating the display section 620 appearing in FIG. 5. In an initial screen shown in FIG. 6A, when the user selects a "finish" key 621 which is a soft key, the screen of the display section 620 is shifted to a finish selection screen shown in FIG. 6B.

Next, the user sets an applied mode. If the user selects a "punch hole" key 622 in the finish selection screen shown in FIG. 6B, the screen of the display section 620 is shifted to a shifting execution/non-execution selection screen shown in FIG. 7A. On the other hand, if the user presses a "close" key 625 in the finish selection screen shown in FIG. 6B, the screen of the display section 620 is shifted to the initial screen shown in FIG. 6A.

Next, the user selects shifting execution or shifting non-execution. The term "shifting" here is intended to mean an operation for moving a conveyed sheet in the lateral direction orthogonal to the sheet conveying direction to thereby correct displacement of the sheet from the defined center position in the lateral direction. After the user selects a "shifting execution" key 626 in the shifting execution/non-execution selection screen shown in FIG. 7A, if the user presses a "next" key 629, the screen of the display section 620 is shifted to a shifting sheet count-setting screen shown in FIG. 7B. On the other hand, after the user selects a "shifting non-execution" key 627 in the shifting execution/non-execution selection screen shown in FIG. 7A, if the user presses the "next" key 629, the screen of the display section 620 is shifted to the initial screen shown in FIG. 6A. Further, if the user presses a "return" key 628 in the shifting execution/non-execution selection screen shown in FIG. 7A, the screen of the display section 620 is shifted to the finish selection screen shown in FIG. 6B.

Next, the user sets the number of sheets to be shifted (shifting sheet count). After the user sets the number of sheets to be shifted by the ten keys 604 to 612, and 614 in a number inputting box 630 in the shifting sheet count-setting screen shown in FIG. 7B, if the user presses a "next" key 632, the screen of the display section 620 is shifted to the initial screen shown in FIG. 6A. On the other hand, if the user presses a "return" key 631 in the shifting sheet count-setting screen shown in FIG. 7B, the screen of the display section 620 is shifted to the shifting execution/non-execution selection screen shown in FIG. 7A. Once the number of sheets to be shifted is set in the shifting sheet count-setting screen, the shifting operation of the sheets is performed every set number of sheets.

After the above series of operations are completed, if the user presses the start button 602, image formation is performed by the image forming apparatus 10 and punching is performed by the finisher 500.

Next, a procedure of punching operations by the finisher 500 will be described with reference to FIGS. 4, and 8 to 17.

Figure 8:
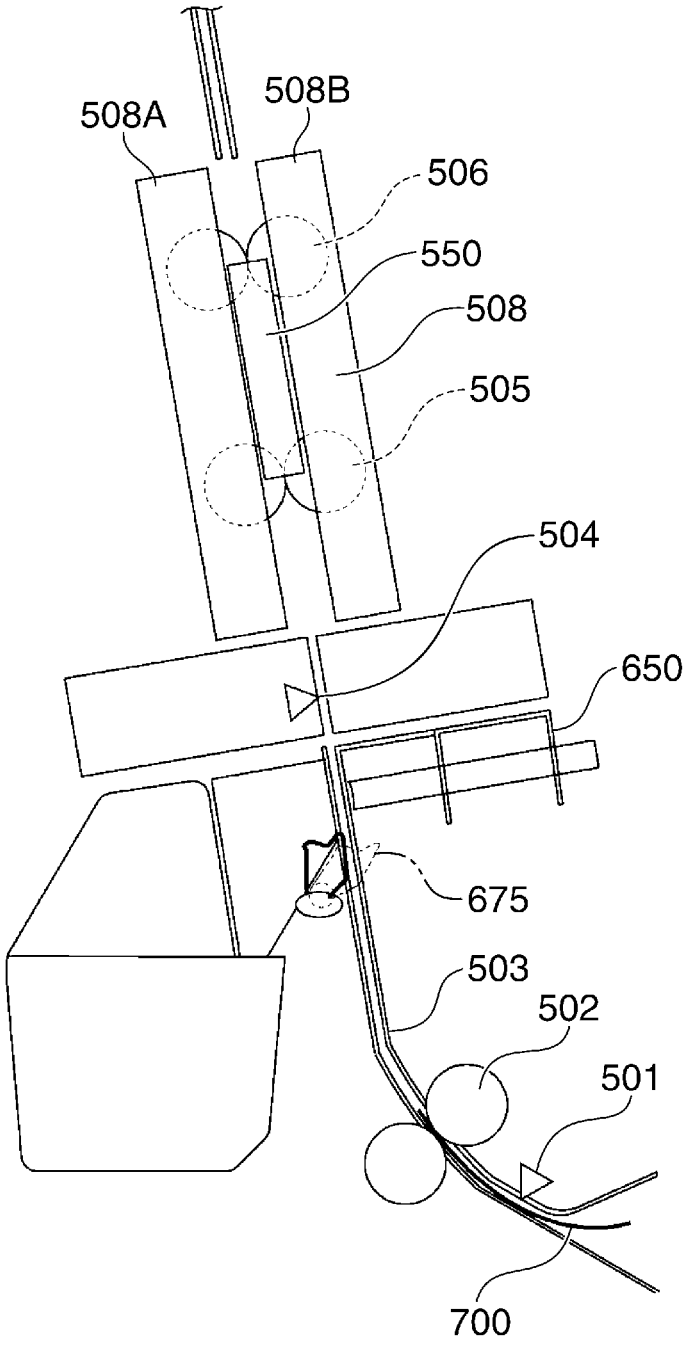
FIG. 8 is a cross-sectional view of a punching mechanism when arrival of a sheet is awaited.

The CPU 952 drives the inlet conveying motor M1 at the timing of receiving a sheet conveyance notification command from the image forming apparatus 10, to thereby cause the inlet conveyance roller pair 502 to rotate in the conveying direction. The sheet 700 discharged from the image forming apparatus 10 is passed to the inlet conveyance roller pair 502 of the finisher 500, as shown in FIG. 8. As soon as the sheet 700 passes the inlet sensor 501, the CPU 952 calculates a driving timing t1 of the shift conveying motor M2 and a driving timing t2 of the alignment motor M4 from an input signal from the inlet sensor 501.

Figure 12:
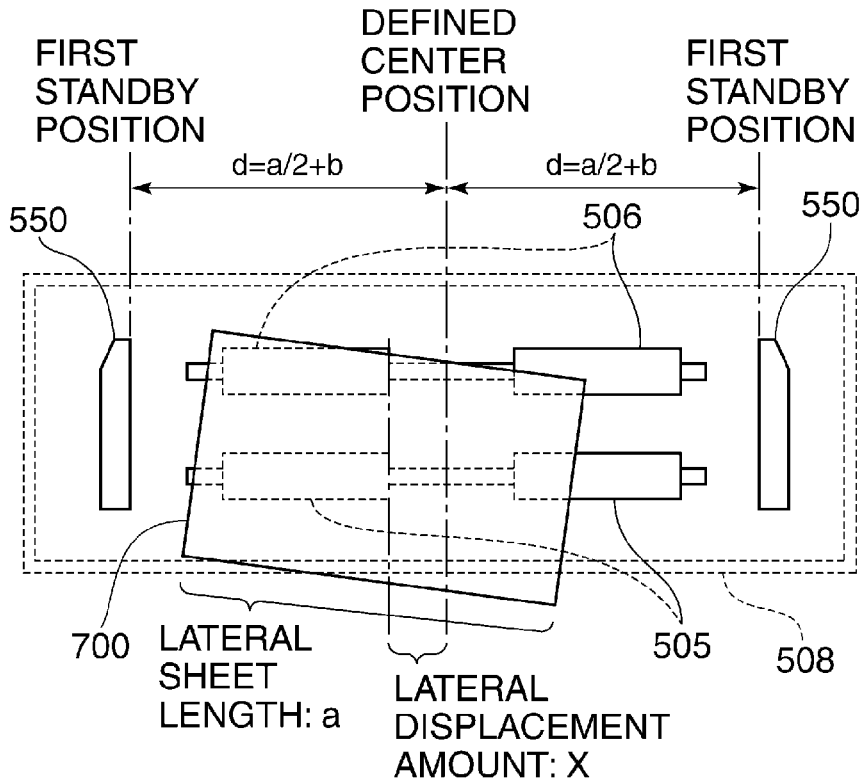
FIG. 12 is a schematic diagram of a shift and skew correction mechanism in a state in which the alignment members are moved to respective first standby positions.
Figure 16:
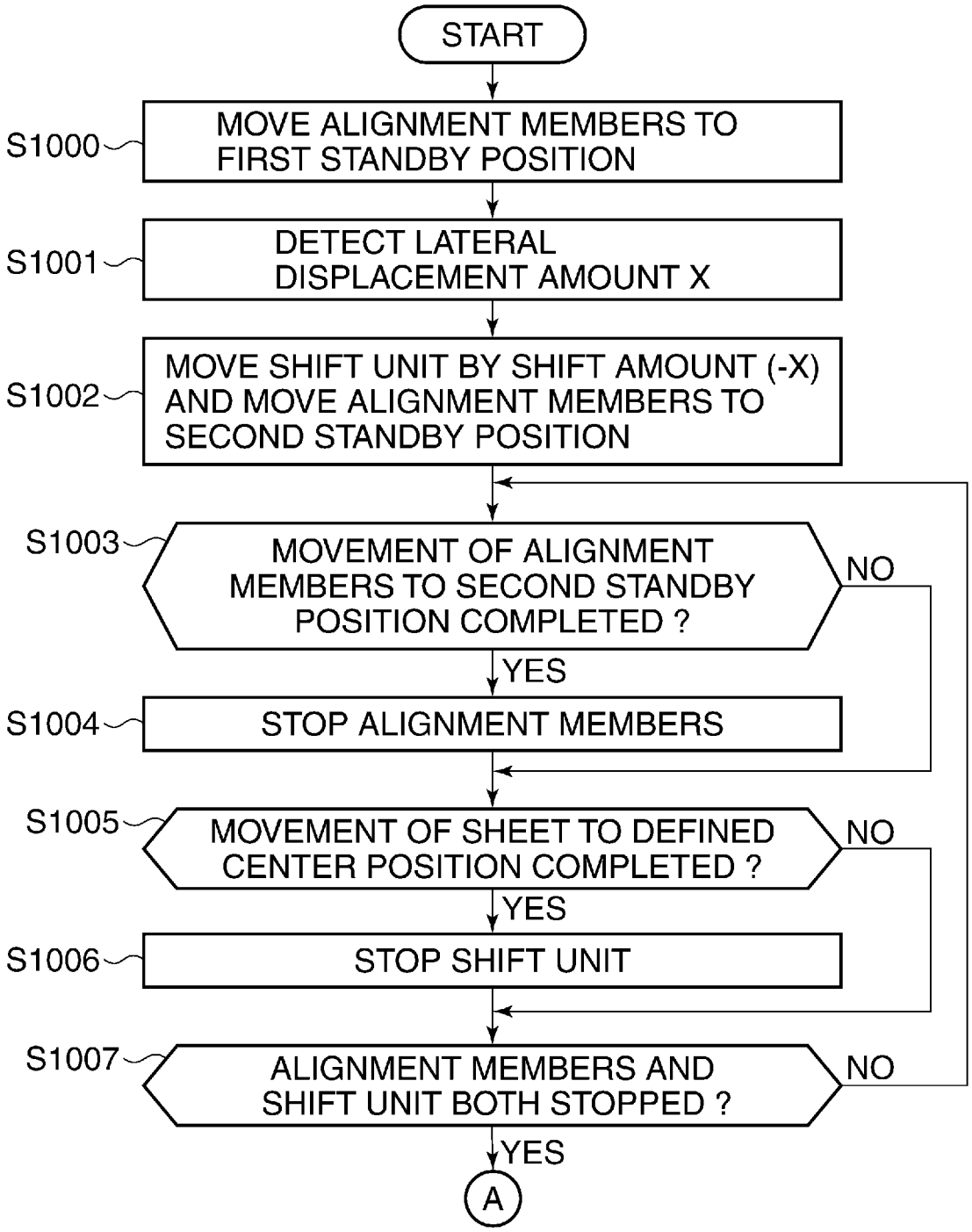
FIG. 16 is a flow chart of a punching process by the finisher.

Next, the CPU 952 drives the alignment motor M4 at the computed driving timing t2 of the alignment motor M4 and, to thereby cause the alignment members 550 to move to respective first standby positions as shown in FIG. 12 (step S1000 in FIG. 16). The first standby positions are each a position away in the lateral direction from the defined center position by a first standby amount "d". Assuming that a sheet length in the lateral direction is represented by "a" and the maximum estimated value of the lateral displacement amount is represented by "b", the first standby amount "d" can be computed by the following equation (1):

$$d=a/2+b \quad (1)$$

That is, each first standby position differs according to the size of the lateral direction of the sheet.

Further, the CPU 952 may determine the first standby position in the following manner: The CPU 952 determines, based on the position of a lateral edge of the sheet 700 detected by the sheet position detection sensor 504 and the sheet length "a" in the lateral direction, the position of a sheet edge which is farther from the defined center position than the other, and sets a position a predetermined amount k away outward from the determined position of the sheet edge as the first standby position. The predetermined amount k is an amount of retraction for preventing the sheet being conveyed from colliding with any of the alignment members 550. Therefore, in this case, the first standby amount d can be computed by the following equation (2):

$$d=a/2+X+k \quad (2)$$

That is, each first standby position differs according to the size of the sheet in the lateral direction and the lateral displacement amount of the sheet.

Further, the CPU 952 drives the shift conveying motor M2 at the computed driving timing t1 of the shift conveying motor M2 and causes the first shift conveyance roller pair 505 and the second shift conveyance roller pair 506 to rotate in the conveying direction. As soon as the sheet 700 being conveyed by the inlet conveyance roller pair 502 passes the sheet position detection sensor 504 by way of the conveyance passage 503, the position of an edge of the sheet 700 in the lateral direction orthogonal to the conveying direction is detected by an input signal from the sheet position detection sensor 504. The CPU 952 computes a lateral displacement amount X based on the detection of the position of the edge (step S1001). Then, the sheet 700 is passed to the first shift conveyance roller pair 505 and the second shift conveyance roller pair 506.

Figure 13:
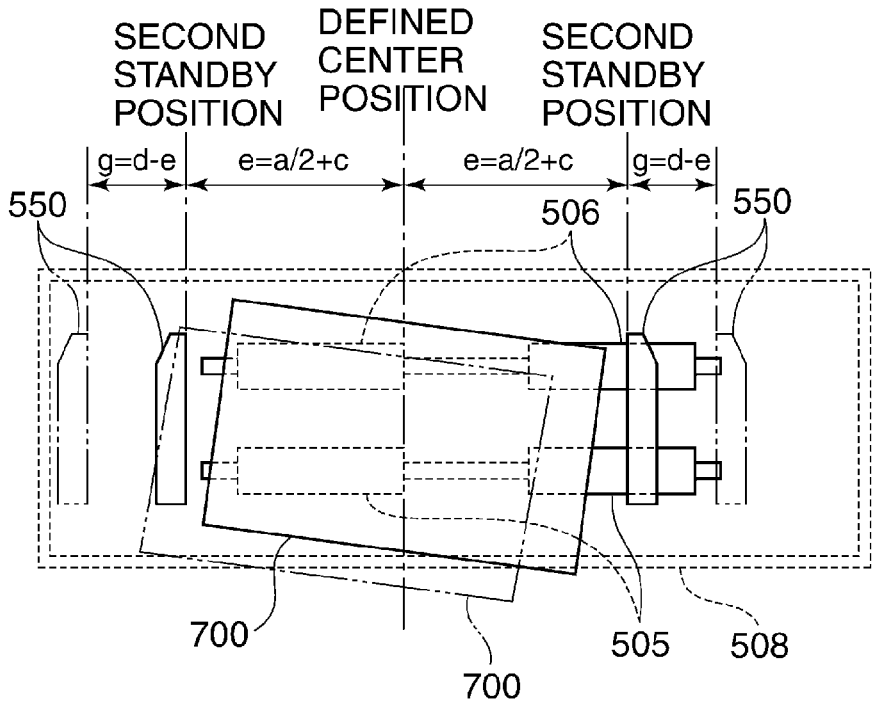
FIG. 13 is a schematic diagram of the shift and skew correction mechanism in a state in which the alignment members are moved to respective second standby positions in parallel with a shifting operation.

Next, the CPU 952 causes the shifting operation by the shift unit 508 and the movement of the alignment members 550 to be executed in parallel (step S1002). To correct displacement of the sheet 700 in the lateral direction orthogonal to the conveying direction based on the lateral displacement amount X, the CPU 952 drives the shift motor M3 to shift the shift unit 508, thereby moving the sheet 700 to the defined center position. In parallel with this movement of the sheet 700 by the shifting operation, as shown in FIG. 13, the CPU 952 drives the alignment motor M4 to move the alignment members 550 to respective second standby positions. The second standby positions are each a position moved from the first standby position toward the defined center position by a predetermined distance "g". That is, the second standby positions are each a position of each alignment member 550 away in the lateral direction from the defined center position by a second standby amount "e" (e=d−g). Assuming that a distance over which the sheet 700 is required to be moved by the alignment members 550 for alignment (hereinafter referred to as "alignment requiring amount c") is represented by "c", the second standby amount "e" can be computed by the following equation (3):

$$e=a/2+c \quad (3)$$

The alignment requiring amount "c" is smaller than the maximum estimated value of the lateral displacement amount "b". Each second standby position differs according to the size of the lateral direction of the sheet.

Upon determining that the movement of each alignment member 550 from the first standby position to the second standby position is completed (YES to step S1003), the CPU 952 stops driving the alignment motor M4 to thereby stop the alignment members 550 (step S1004).

Next, upon determining that the shift unit 508 has moved the sheet 700 towards the defined center position by the lateral displacement amount X (YES to step S1005), the CPU 952 stops driving the shift motor M3 to thereby stop the shift unit 508 (step S1006).

Figure 9:
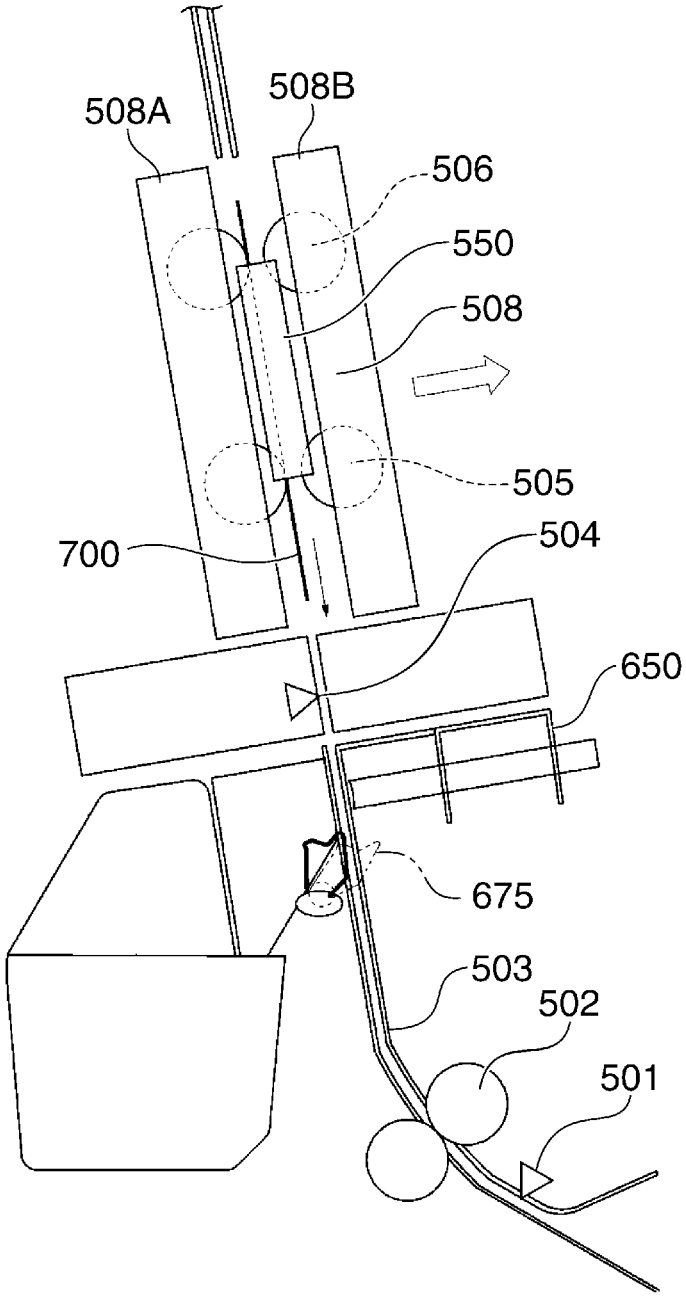
FIG. 9 is a cross-sectional view of the punching mechanism when a separation operation is performed for the sheet.
Figure 17:
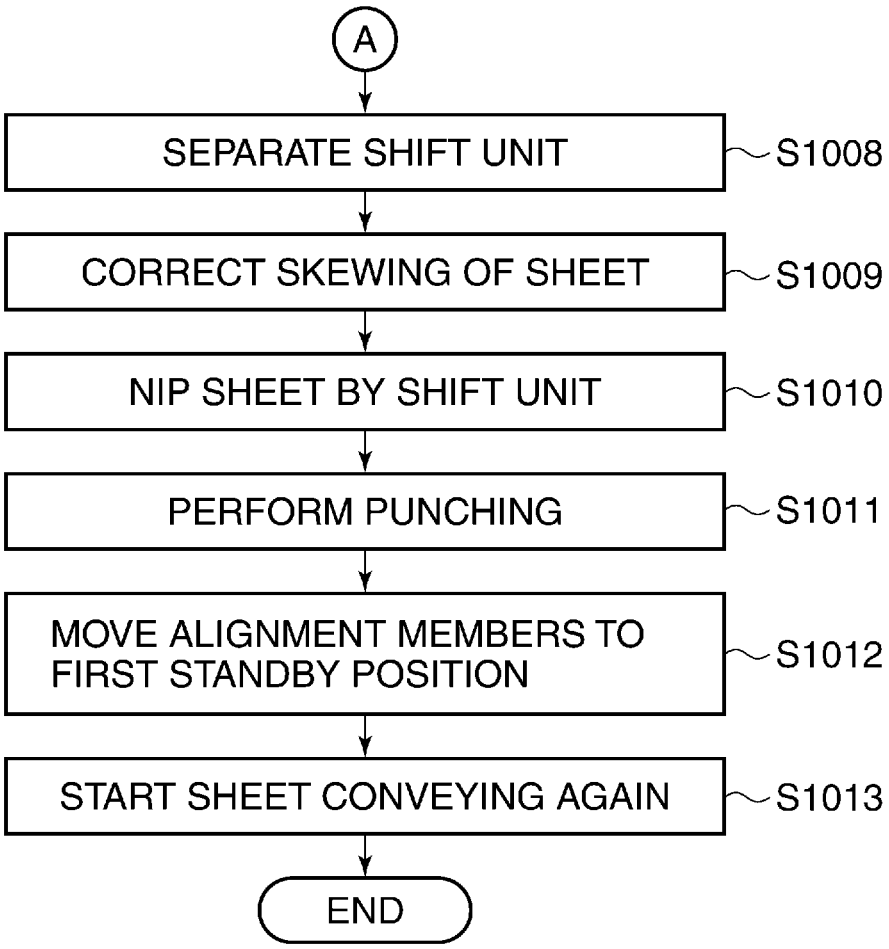
FIG. 17 is a continuation of FIG. 16.

Upon determining that both the movements of the alignment members 550 and the shift unit 508 are completed (step S1007), the CPU 952 drives, as shown in FIG. 9, the shift separation motor M10 to thereby cause the shift unit 508 to perform a separating operation (step S1008 in FIG. 17). As a result, the sheet 700 moves in an opposite direction to the conveying direction under its own weight. The shift unit 508 is configured to be tilted such that the sheet 700 moves in the opposite direction to the conveying direction under its own weight. After the shift unit 508 has performed the separating operation, the CPU 952 drives the shift motor M3 to thereby cause the shift unit 508 to return to a reference position (home position).

Figure 14:
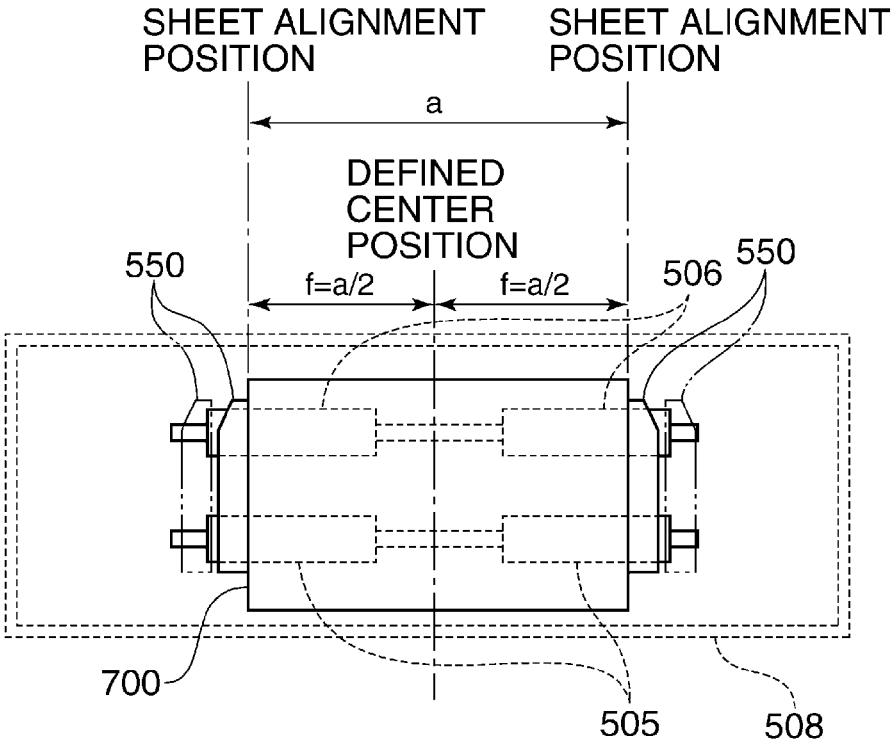
FIG. 14 is a schematic diagram of the shift and skew correction mechanism during correcting skewing of the sheet.

Next, the CPU 952 drives the alignment motor M4 to thereby cause each alignment member 550 to move to a sheet alignment position, as shown in FIG. 14, such that skewing of the sheet 700 is corrected (step S1009). The sheet alignment position is a position away in the lateral direction from the defined center position by a sheet alignment amount "f". Assuming that the sheet length in the lateral direction is represented by "a", the sheet alignment amount "f" can be computed by the following equation (4):

$$f=a/2 \quad (4)$$

Figure 10:
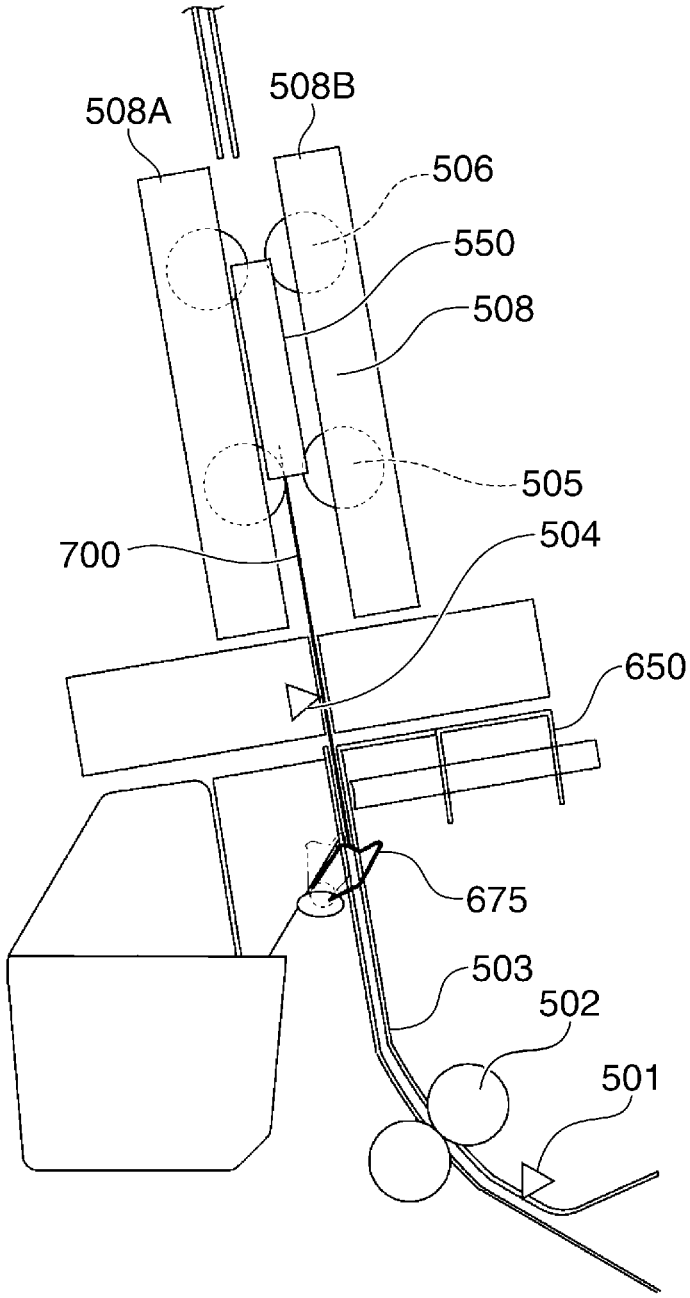
FIG. 10 is a cross-sectional view of the punching mechanism when the sheet is abutted.
Figure 11:
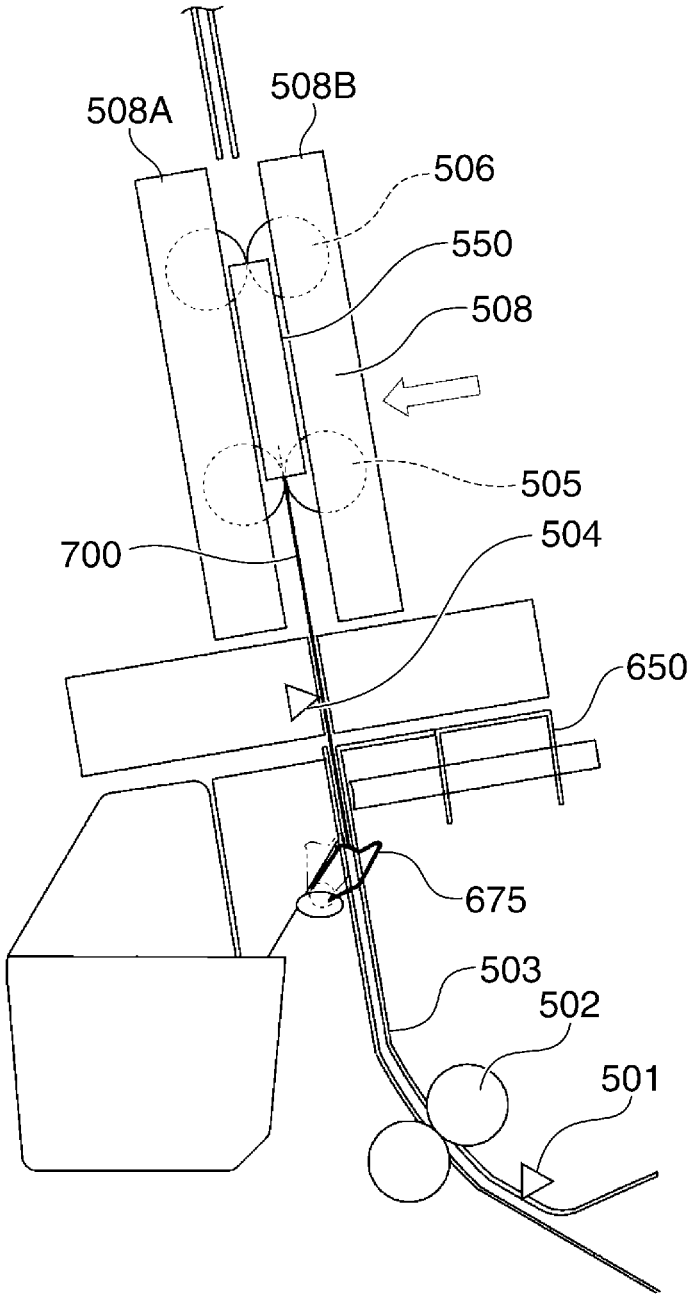
FIG. 11 is a cross-sectional view of the punching mechanism when the sheet is switched back.

When a predetermined time elapses after the shift unit 508 is moved away (separates) from the sheet 700, the trailing end of the sheet 700 abuts against the rear end stopper member 675, as shown in FIG. 10. Next, the CPU 952 drives the shift separation motor M10 to thereby nip the sheet 700 between the fixed member 508A and movable member 508B of the shift unit 508 to (step S1010), as shown in FIG. 11. Note that there is no drive source for driving the rear end stopper member 675, but the rear end stopper member 675 is configured to be moved over the conveyance passage 503 by a rear end stopper mechanism, not shown, in association with the driving of the alignment member 550.

Figure 15:
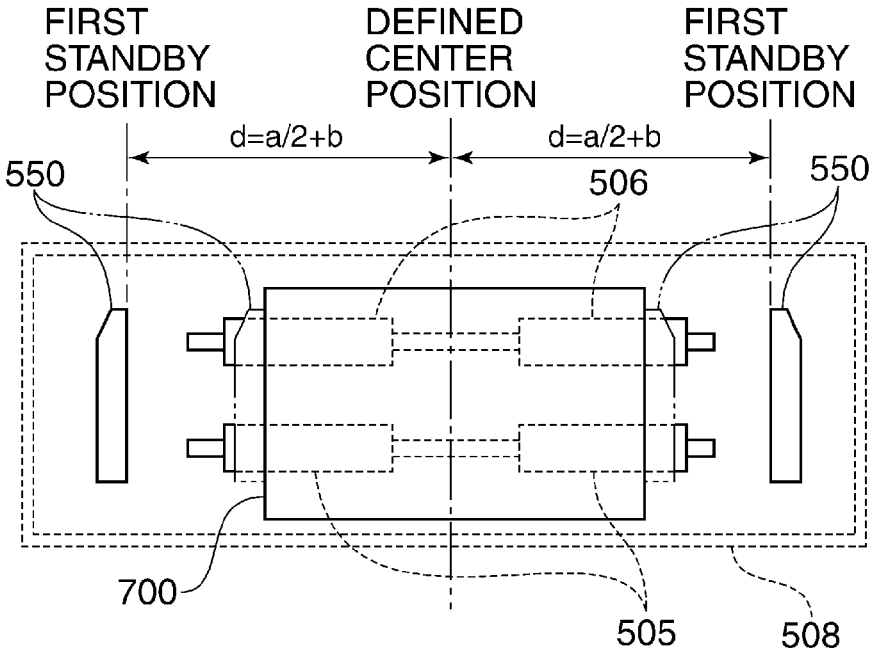
FIG. 15 is a schematic diagram of the shift and skew correction mechanism after correcting skewing of a sheet.

Next, the CPU 952 drives the punch motor M5 to perform punching on the trailing end of the sheet 700 (step S1011). After the punching of the sheet 700 is completed, as shown in FIG. 15, the CPU 952 drives the alignment motor M4 to cause the alignment members 550 to move to the respective first standby positions (step S1012). Then, the CPU 952 drives the shift conveying motor M2 to cause the sheet 700 to be conveyed downstream of the sheet conveyance passage (step S1013).

As described above, in the embodiment, the shifting operation of the shift unit 508 and the moving operation of the alignment member 550 are performed in parallel. This makes it possible to shorten the time required for shifting and alignment of a sheet and improve the productivity of punching. Further, even if a sheet being conveyed is largely displaced from the defined center position, the sheet from is not brought into contact with any of the alignment members to prevent the sheet from being damaged, whereby it is possible to preserve the quality of the sheet.

Aspects of the present invention can also be realized by a computer of a system or apparatus (or devices such as a CPU or MPU) that reads out and executes a program recorded on a memory device to perform the functions of the above-described embodiments, and by a method, the steps of which are performed by a computer of a system or apparatus by, for example, reading out and executing a program recorded on a memory device to perform the functions of the above-described embodiments. For this purpose, the program is provided to the computer for example via a network or from a recording medium of various types serving as the memory device (e.g., computer-readable medium).

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims priority from Japanese Patent Application No. 2012-002152 filed Jan. 10, 2012, and Japanese Patent Application No. 2012-279474 filed Dec. 21, 2012, which are hereby incorporated by reference herein in their entirety.

What is claimed is:

1. A post-processing apparatus comprising:

a conveying unit configured to convey a sheet;

a shift unit configured to perform a shifting operation for shifting the sheet conveyed by said conveying unit in a lateral direction orthogonal to a sheet conveying direction;

an alignment unit configured to align the sheet, said alignment unit including a pair alignment members that are movable toward each other so that side edges of the sheet in the lateral direction contact therebetween to thereby align the sheet; and a control unit configured to control said alignment unit and said shift unit such so that an operation for moving said pair of alignment members from respective first standby positions in the lateral direction to respective second standby positions, at which said pair of alignment members do not contact the sheet, the respective second standby positions being closer to the sheet than the corresponding first standby positions, is executed in parallel with the shifting operation by said shift unit.

2. The post-processing apparatus according to claim 1, wherein the first standby positions differ according to a size of the sheet in the lateral direction.

3. The post-processing apparatus according to claim 2, wherein the first standby positions are each a position away from a defined position in the lateral direction, by an amount obtained by adding a predetermined value to a half of the size of the sheet.

4. The post-processing apparatus according to claim 2, further comprising:

a detection section configured to detect a position of an edge of the sheet in the lateral direction, wherein the first standby positions are each a position determined according to a difference between the position of the edge of the sheet detected by said detection section and a defined position in the lateral direction, and a size of the sheet in the lateral direction.

5. The post-processing apparatus according to claim 4, wherein the first standby positions are each a position away from the defined position in the lateral direction, by an amount obtained by adding the difference and a predetermined value to a half of the size of the sheet.

6. The post-processing apparatus according to claim 1, further comprising:

a detection section configured to detect a position of an edge of the sheet in the lateral direction, wherein said control unit controls said shift unit so that the shifting operation is performed based on the position of the edge of the sheet detected by said detection section.

7. The post-processing apparatus according to claim 6, wherein said control unit controls said shift unit so that a position of a center of the sheet in the lateral direction is moved to a defined position in the lateral direction.

8. The post-processing apparatus according to claim 7, wherein the second standby positions are positions where said pair of alignment members are on standby respectively for causing the sheet moved to the defined position by said shift unit to be aligned by said alignment unit.

9. The post-processing apparatus according to claim 8, wherein the second standby positions are each a position away from an associated edge of the sheet in the lateral direction, which is moved to the defined position by said shift unit by a predetermined amount.

10. The post-processing apparatus according to claim 7, wherein:

said shift unit has a pair of rollers for nipping the sheet, said pair of rollers being separable from each other, and said control unit controls said shift unit and said alignment unit so that after said shift unit is caused to shift the sheet to the defined position, said pair of rollers are caused to be separated from each other, and after said pair of rollers are caused to be separated from each other, said pair of alignment members on standby in the respective second standby positions are caused to hold side edges of the sheet in the lateral direction therebetween to thereby align the sheet.

11. The post-processing apparatus according to claim 10, further comprising:

a punching unit configured to perform punching on the sheet, wherein said control unit controls said shift unit and said alignment unit so that after said alignment unit is caused to align the sheet, said pair of rollers are caused to nip the sheet, and said punching unit is caused to perform punching on the nipped sheet.

12. A method of controlling a post-processing apparatus including a conveying unit configured to convey a sheet, a shift unit configured to perform a shifting operation for shifting the sheet conveyed by the conveying unit in a lateral direction orthogonal to a sheet conveying direction, and an alignment unit configured to align the sheet, the alignment unit including a pair alignment members that are movable toward each other so that side edges of the sheet in the lateral direction-contact therebetween to thereby align the sheet, the method comprising the steps of:

moving the sheet to a defined position in the lateral direction by the shift unit;

moving the pair of alignment members, before an alignment operation by the alignment unit, from respective first standby positions in the lateral direction to respective second standby positions, at which the pair of alignment members do not contact the sheet, the respective second standby positions being closer to the sheet than the corresponding first standby positions; and controlling an execution timing of shifting of the sheet to the defined position in the lateral direction and an execution timing of movement of the pair of alignment members to the respective second standby positions so that the shifting of the sheet to the defined position in the lateral direction and the movement of the pair of alignment members to the respective second standby positions are executed in parallel with each other.

* * * * *